US011166499B2

(12) United States Patent
Vescovi

(10) Patent No.: US 11,166,499 B2
(45) Date of Patent: Nov. 9, 2021

(54) JOINT PAD ASSEMBLY

(71) Applicant: Greg Vescovi, Indianapolis, IN (US)

(72) Inventor: Greg Vescovi, Indianapolis, IN (US)

( * ) Notice: Subject to any disclaimer, the term of this patent is extended or adjusted under 35 U.S.C. 154(b) by 199 days.

(21) Appl. No.: 16/162,381

(22) Filed: Oct. 16, 2018

(65) Prior Publication Data

US 2020/0113255 A1 Apr. 16, 2020

(51) Int. Cl.
*A41D 13/06* (2006.01)

(52) U.S. Cl.
CPC ..... *A41D 13/065* (2013.01)

(58) Field of Classification Search
CPC ..... A41D 13/065; A41D 13/05
USPC ..... 2/24; D29/121.1
See application file for complete search history.

(56) References Cited

U.S. PATENT DOCUMENTS 5,255,391 A 10/1993 Levine
5,537,689 A 7/1996 Dancyger
5,987,643 A 11/1999 Beutler
6,098,208 A * 8/2000 Cordon ..... A63B 71/08 2/16
6,253,376 B1 7/2001 Ritter
6,374,408 B1 * 4/2002 Tomlinson ..... A41D 13/0568 2/16
6,427,239 B1 * 8/2002 Worden ..... A41D 13/065 2/22
6,584,616 B2 7/2003 Godshaw et al.
6,807,682 B1 10/2004 Shircliff
6,820,279 B2 11/2004 Lesosky
7,181,770 B2 2/2007 Godshaw
7,448,088 B2 11/2008 Miller
7,512,996 B2 * 4/2009 Yoo ..... A63B 71/1225 2/455
7,937,768 B2 * 5/2011 Behrend ..... A41D 13/0543 2/22
2005/0114976 A1 * 6/2005 Beland ..... A63B 71/1225 2/22
2015/0290046 A1 * 10/2015 Novick ..... A61F 5/0106 602/26
2018/0153233 A1 * 6/2018 Paquette ..... A41D 13/0568

* cited by examiner

*Primary Examiner* — Joshua T Kennedy
(74) *Attorney, Agent, or Firm* — Faegre Drinker Biddle & Reath LLP

(57) ABSTRACT

The present disclosure provides an improved joint pad assembly, which includes a socket assembly that is canted and is configured to distribute an applied force to a lateral edge surface of the socket assembly. The socket assembly is asymmetrical in design and includes an aperture that is offset from the joint it is configured to receive.

19 Claims, 13 Drawing Sheets

JOINT PAD ASSEMBLY

TECHNICAL FIELD OF THE PRESENT DISCLOSURE

The present invention generally relates to joint pads and personal protective equipment, and more particularly, to a non-slip joint pad design.

BACKGROUND OF THE PRESENT DISCLOSURE

Many occupations and activities may require the use of knee pads to carry out work-related tasks, actions, and functions. These can include, for example, kneeling on a hard surface for a period of time, standing up from a kneeling position, and re-assuming a kneeling position from a standing position. When kneeling, the standard knee pad may provide the wearer with some relief from acute discomfort caused by the knee cap resting on a hard surface. However, the standard knee pad does not provide stability in terms of preventing horizontal movements or other pressures on the knee pad and the knee joint itself. Also, the standard knee pad, due to its construction, may not remain in place along a user's leg through the previously mentioned movements.

In addition to the wide range of movements imparted upon the knee pad, many knee pads are designed to be worn over the wearer's clothing (e.g., pants). The clothing layer may cause additional instability in the securement of the knee pad on the user's leg. That is, the knee pad may slide along the user's leg requiring the user to continuously adjust the knee pad.

Thus, there exists a need for a knee pad design and joint pad design, in general, that can be worn under clothes and increases stability and comfort through various movements of the user.

SUMMARY OF THE PRESENT DISCLOSURE

The present disclosure provides an improved joint pad assembly, which includes a socket assembly that is canted and is configured to distribute an applied force to a lateral edge surface of the socket assembly. The socket assembly is asymmetrical in design and includes an aperture that is offset from the joint it is configured to receive.

In one embodiment of the present disclosure, a joint pad assembly is provided. The joint pad assembly comprises a socket assembly including: a socket including a frame that includes a front face, a rear concave face configured to receive a joint of a user, a lateral edge surface and a medial edge surface; wherein the lateral edge surface has a lateral edge surface height that is larger than a medial edge surface height of the medial edge surface.

In another embodiment of the present disclosure, a plane formed by the front face and a plane formed by the lateral edge surface intersect to form an angle between 10 degrees and 20 degrees such that the socket assembly is canted. In another embodiment, the frame surrounds an aperture positioned between the lateral edge surface and the medial edge surface along the front face of the frame, the aperture configured to receive the joint of the user. In yet another embodiment, the aperture is offset from an axis of the user's joint. In another embodiment, the joint pad assembly further includes a securing sleeve comprising a distal end and an upper strap and a lower strap, wherein the lower strap is twice as large as the upper strap. In a further embodiment, the upper strap and the lower strap couple to the distal end to couple the joint pad assembly to the user's joint. In another embodiment, the socket assembly further includes a facet coupled to the socket and received with the rear face of the socket.

In another embodiment of the present disclosure, a joint pad assembly is provided. The joint pad assembly comprises a socket assembly including: a socket including a frame that includes a front face, a rear concave face configured to receive a joint of a user, a lateral edge surface and a medial edge surface; and wherein a plane formed by the front face and a plane formed by the lateral edge surface intersect to form an angle between 10 degrees and 20 degrees such that the socket assembly is canted. In a further embodiment, the frame surrounds an aperture positioned between the lateral edge surface and the medial edge surface along the front face of the frame, the aperture configured to receive the joint of the user. In another embodiment, the aperture is offset from an axis of the user's joint. In another embodiment, the joint pad further includes a securing sleeve comprising a distal end and an upper strap and a lower strap, wherein the lower strap is twice as large as the upper strap. In yet another embodiment, the upper strap and the lower strap couple to the distal end to couple the joint pad assembly to the user's joint. In another embodiment, the socket assembly further includes a facet coupled to the socket and received with the rear face of the socket.

In another embodiment of the present disclosure, a joint pad assembly is provided. The joint pad assembly comprises a socket assembly including: a socket including a frame that includes a front face, a rear concave face configured to receive a joint of a user, a lateral edge surface and a medial edge surface; wherein the frame surrounds an aperture positioned between the lateral edge surface and the medial edge surface along the front face of the frame, the aperture configured to receive the joint of the user; and a facet coupled to the socket and received within the rear face of the frame of the socket, wherein the facet is configured to squarely receive the joint of a user; and wherein the aperture is offset from an axis of the user's joint.

In another embodiment, the aperture of the socket is offset from the axis of the user's joint by an angle between 10 degrees and 15 degrees. In another embodiment, the lateral edge surface has a lateral edge surface height that is larger than a medial edge surface height of the medial edge surface. In another embodiment, a plane formed by the front face and a plane formed by the lateral edge surface intersect to form an angle between 10 degrees and 20 degrees such that the socket assembly is canted. In another embodiment, the joint pad assembly further includes a securing sleeve comprising a distal end and an upper strap and a lower strap, wherein the lower strap is twice as large as the upper strap. In another embodiment, the upper strap and the lower strap couple to the distal end to couple the joint pad assembly to the user's joint. The securing sleeve further includes a cushion coupled to the distal end of the securing sleeve.

DETAILED DESCRIPTION OF THE DRAWINGS

The characteristics and utilities of the present invention described in this summary and the detailed description below are not all inclusive. Many additional features and advantages will be apparent to one of ordinary skill in the art given the following description. There has thus been outlined, rather broadly, the more important features of the invention in order that the detailed description thereof that follows may be better understood, and in order that the present contribution to the art may be better appreciated.

The present disclosure provides an improved joint pad assembly, which includes a socket assembly that is canted and is configured to distribute an applied force to a lateral edge surface of the socket assembly. The socket assembly is asymmetrical in design and includes an aperture that is offset from the joint it is configured to receive.

Figure 1:
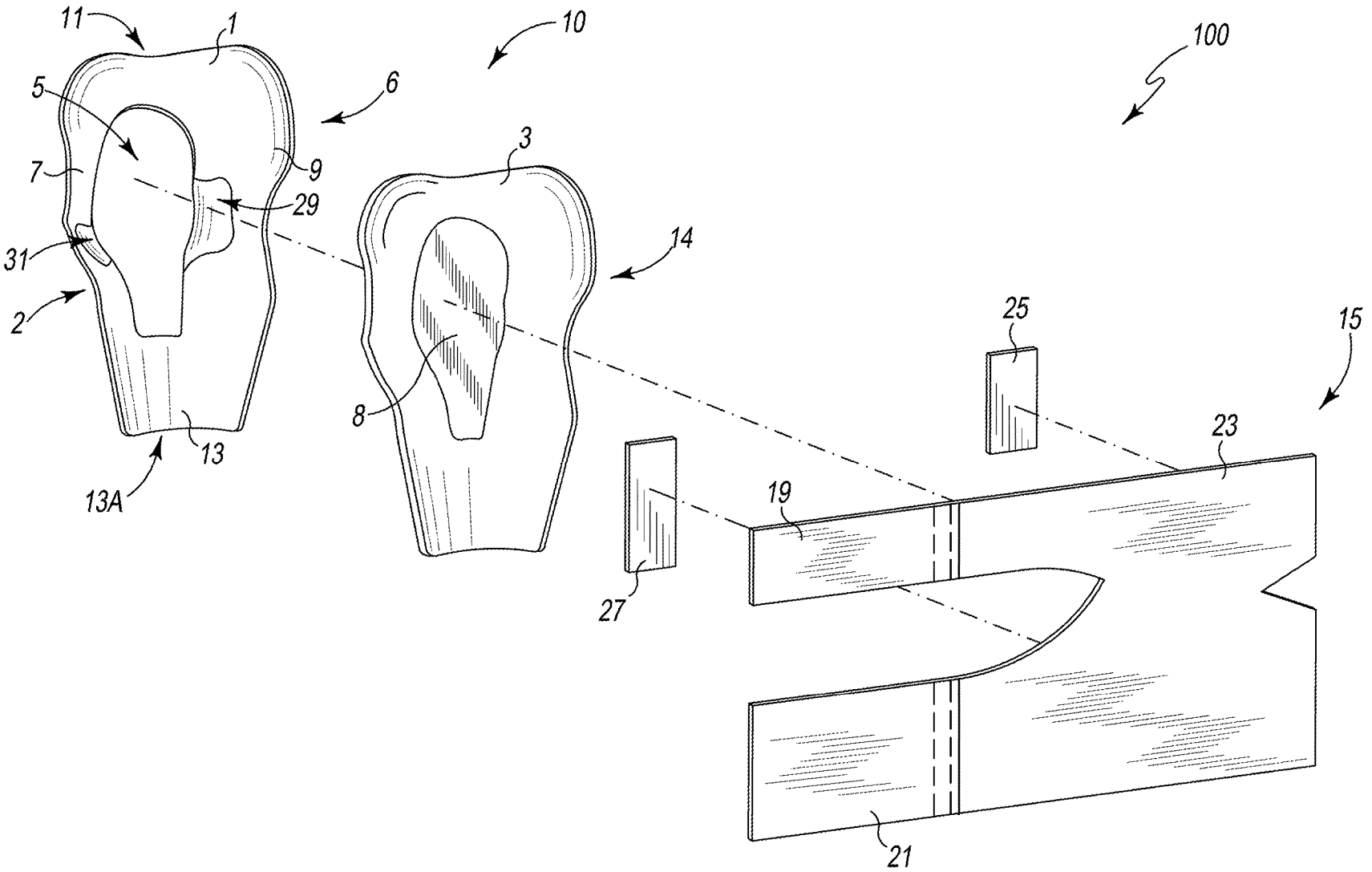
FIG. 1 shows an exploded perspective view of a joint pad assembly in accordance with an illustrative embodiment of the present disclosure.
Figure 2:
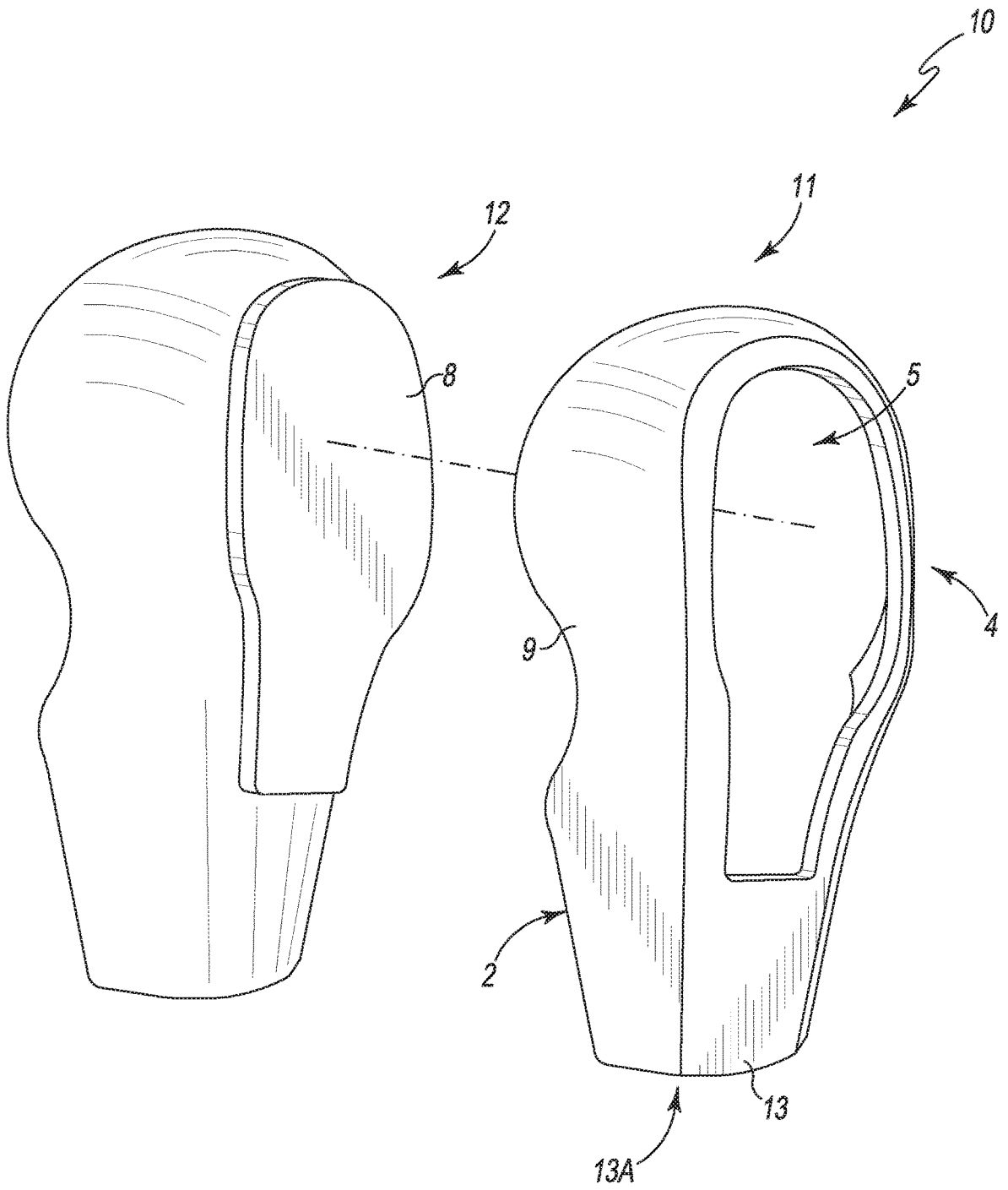
FIG. 2 shows an exploded perspective view of a socket assembly of the joint pad assembly of FIG. 1.
Figure 3:
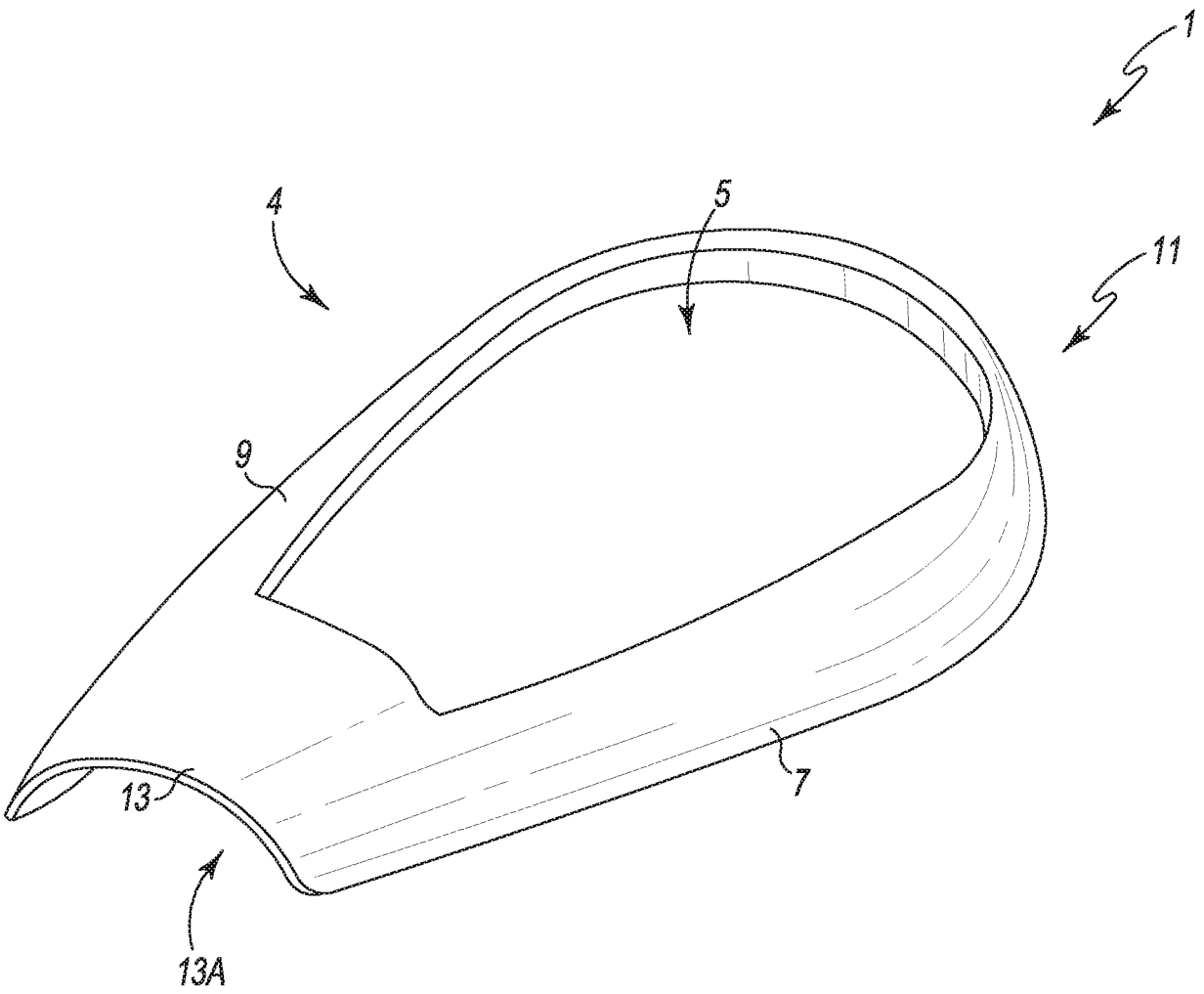
FIG. 3 shows a top perspective view of the socket of the joint pad assembly of FIG. 1.
Figure 4:
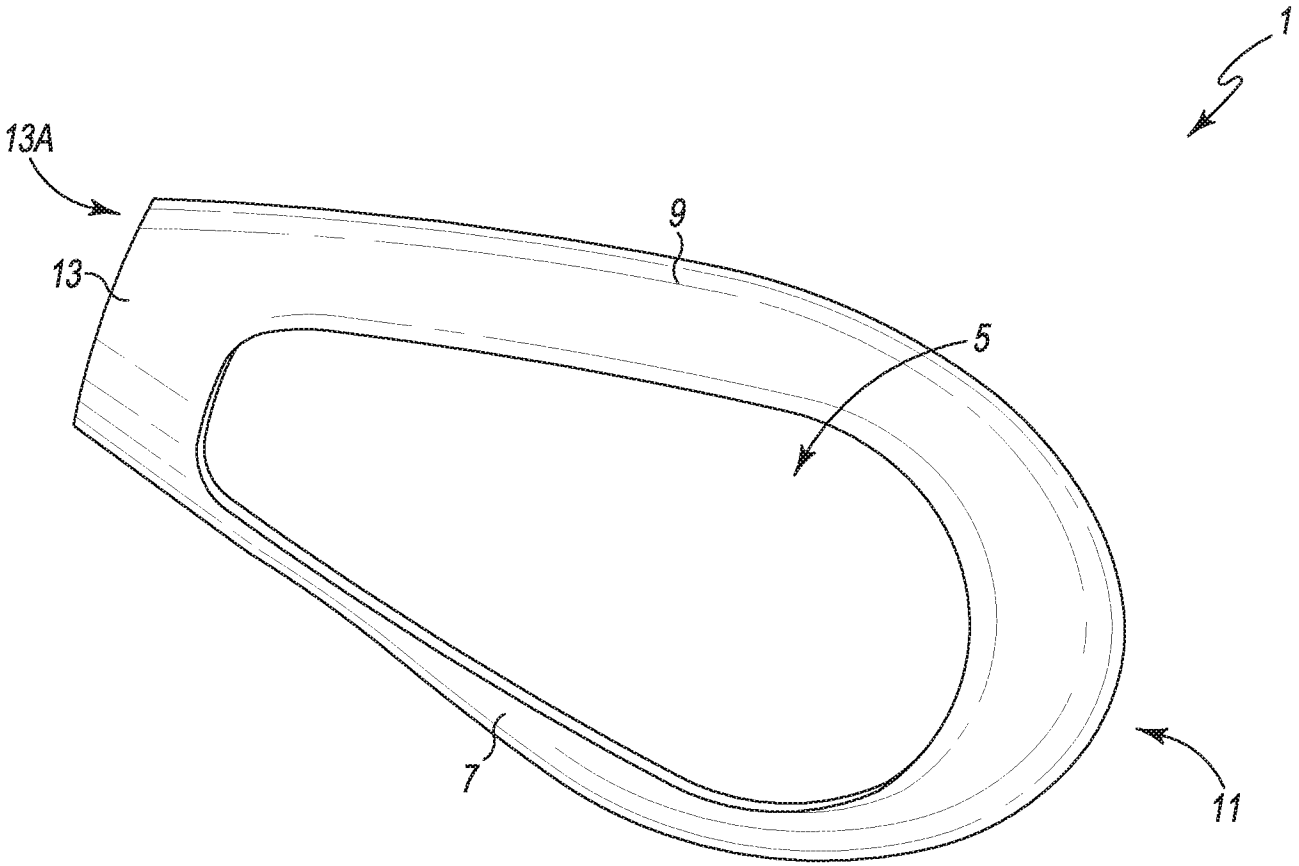
FIG. 4 shows a top perspective view of the socket of the joint pad assembly of FIG. 1.
Figure 5:
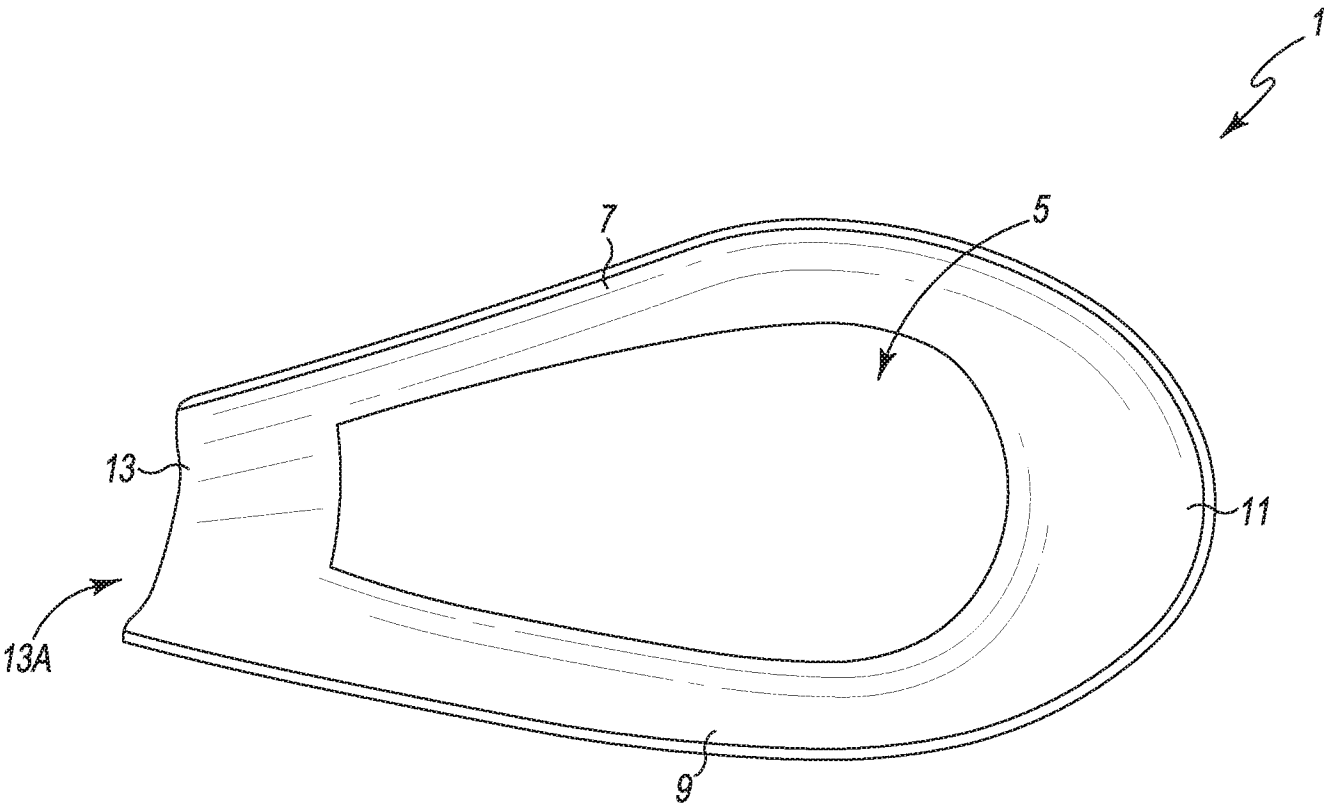
FIG. 5 shows a bottom plan view of the socket of the joint pad assembly of FIG. 1.
Figure 10:
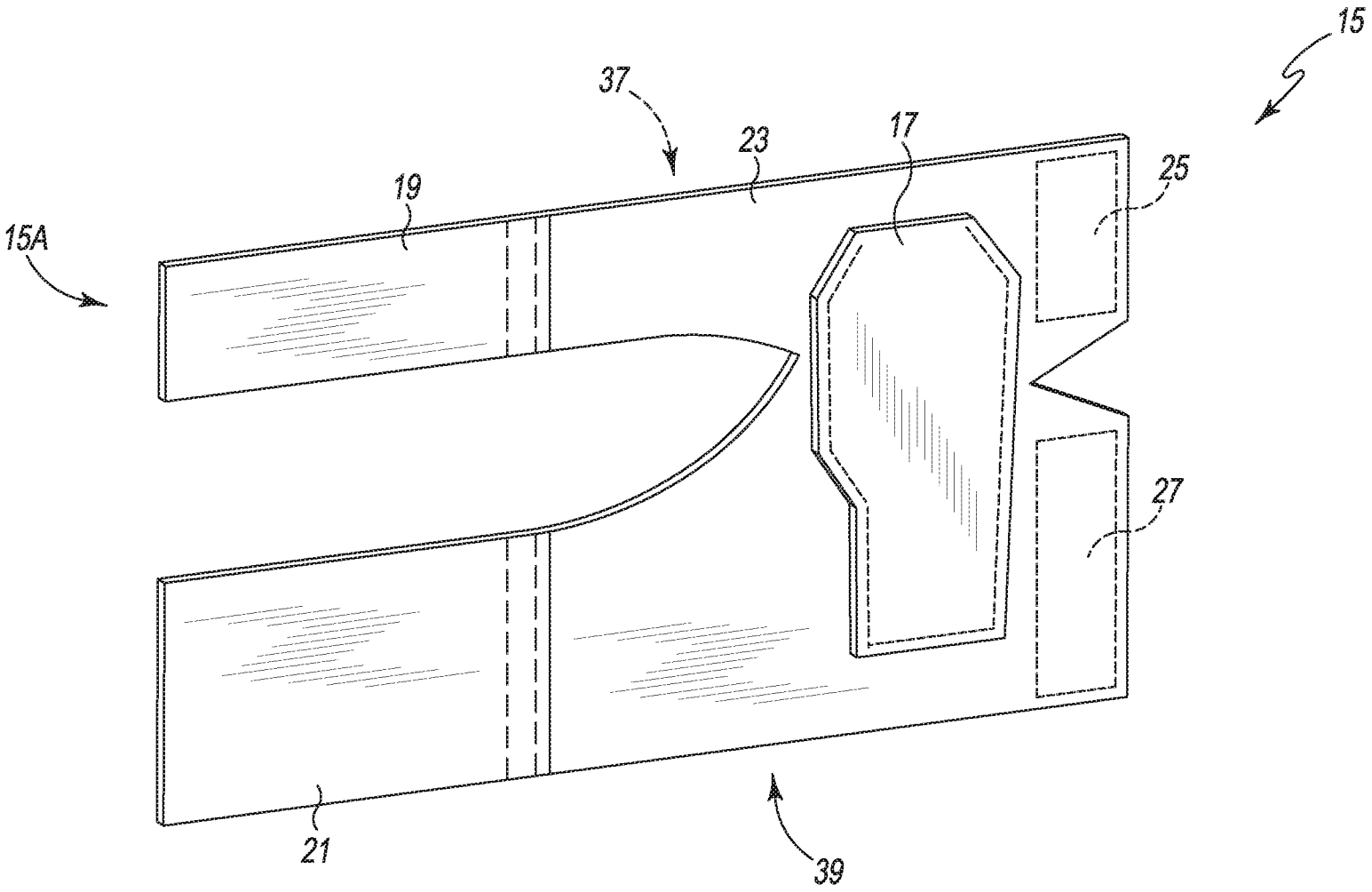
FIG. 10 shows a perspective view of a securing sleeve for use in the joint pad assembly of FIG. 1.

Referring first to FIGS. 1 and 2, a socket assembly 10 of a joint pad assembly 100 is provided. Socket assembly 10 includes a socket 1 and a facet 3 that are removably coupled to each other. In an alternate embodiment, socket 1 and facet 3 are welded to each other. As shown, facet 3 includes a front face 12 and a rear face 14 (FIG. 10). Front face 12 is received in a rear face 6 (FIG. 10) of socket 1, and rear face 14 is contoured and configured to receive a joint of a user (e.g., a knee) and/or a securing sleeve 5 (FIG. 10). Facet 3 can be made of a single or dual density foam padding or cushion. However, it is contemplated that in alternate embodiments, facet 3 is made of other suitable materials, such as silicone gel or polyurethane foam or the like, for example. In one embodiment, facet 3 has a shore hardness between 15 and 30. In a further embodiment, facet 3 has a shore hardness of approximately 25. Socket 1 includes a front face 4 and a rear face 6. Similar to rear face 14 of facet 3, rear face 6 is configured to receive front face 12 of facet 3, and front face 4 is contoured and configured to contact a surface (e.g., the ground when kneeling) when in use as described further herein.

Figure 6:
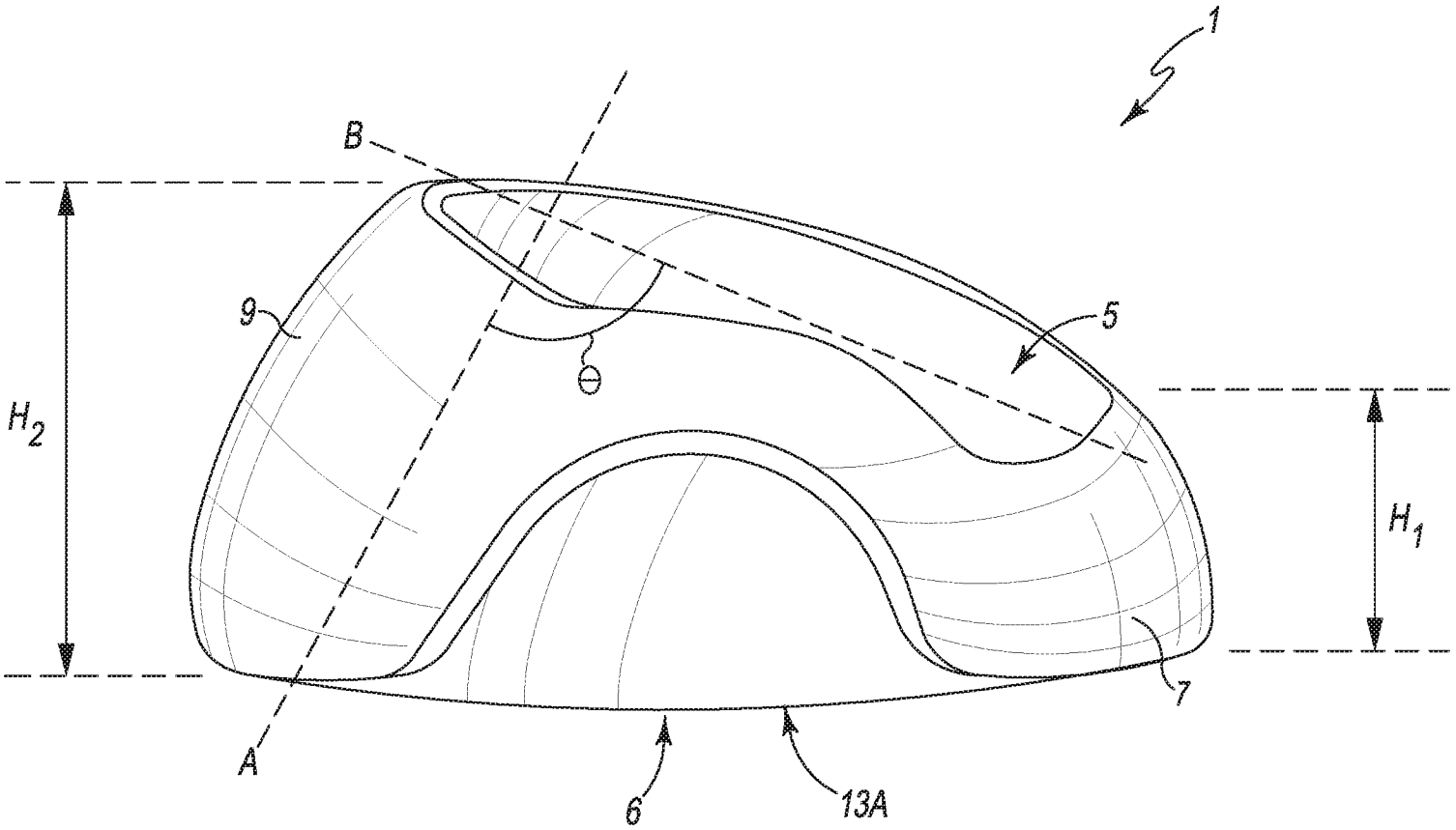
FIG. 6 shows a rear, elevational view of the socket of the joint pad assembly of FIG. 1 from a distal end of the socket.
Figure 7:
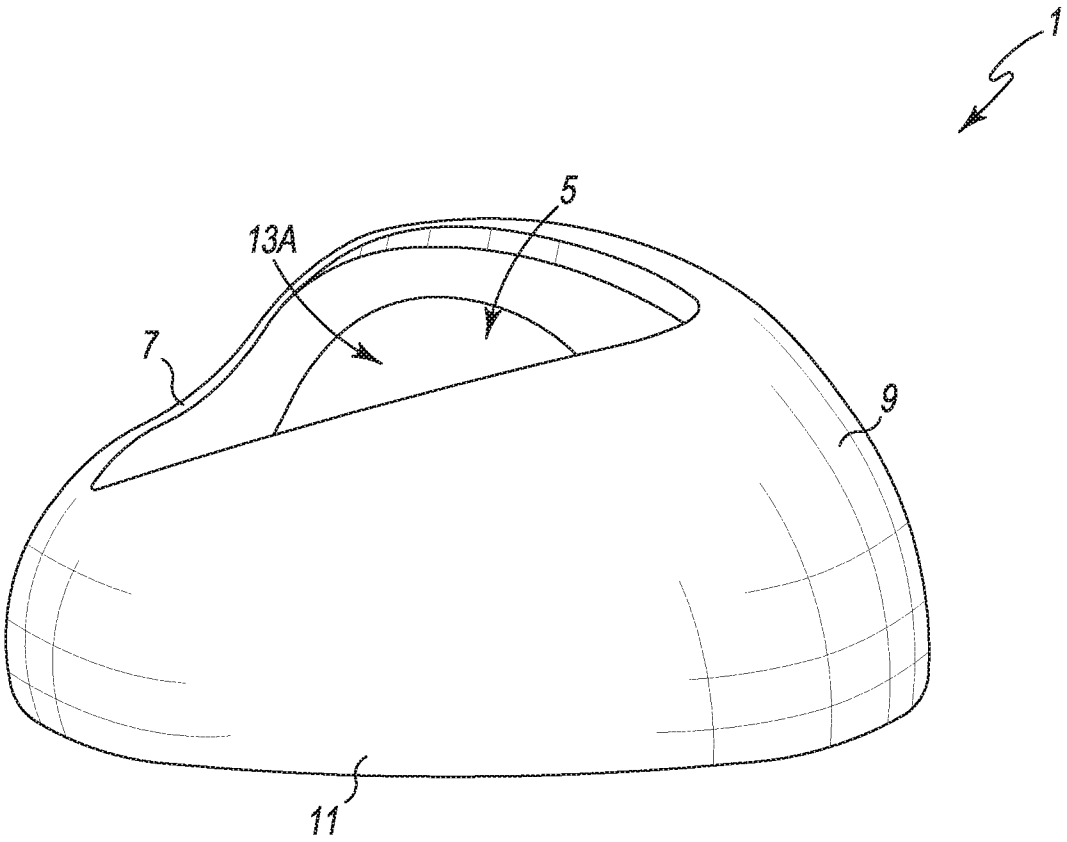
FIG. 7 shows a front, elevational view of the socket of the joint pad assembly of FIG. 1 from a proximal end of the socket.
Figure 8:
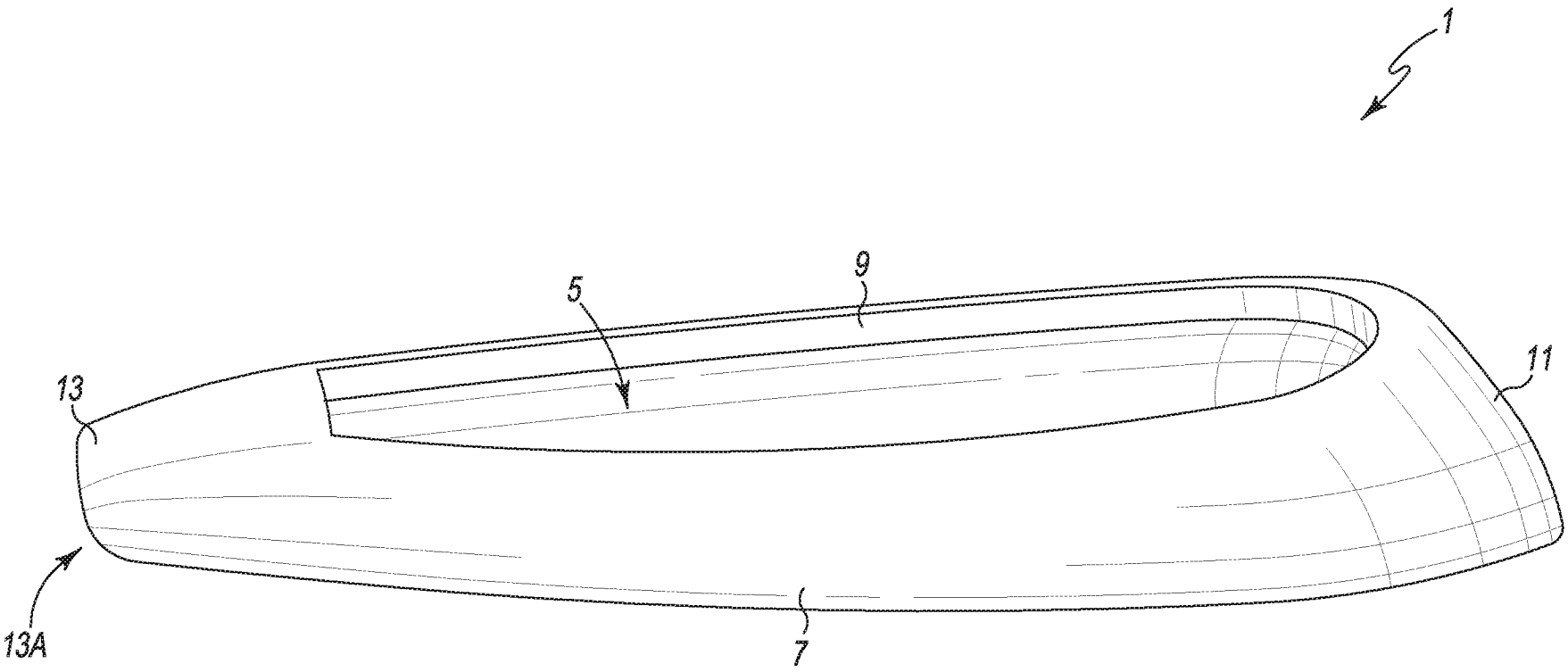
FIG. 8 shows a side, perspective view of the socket of the joint pad assembly of FIG. 1.
Figure 9:
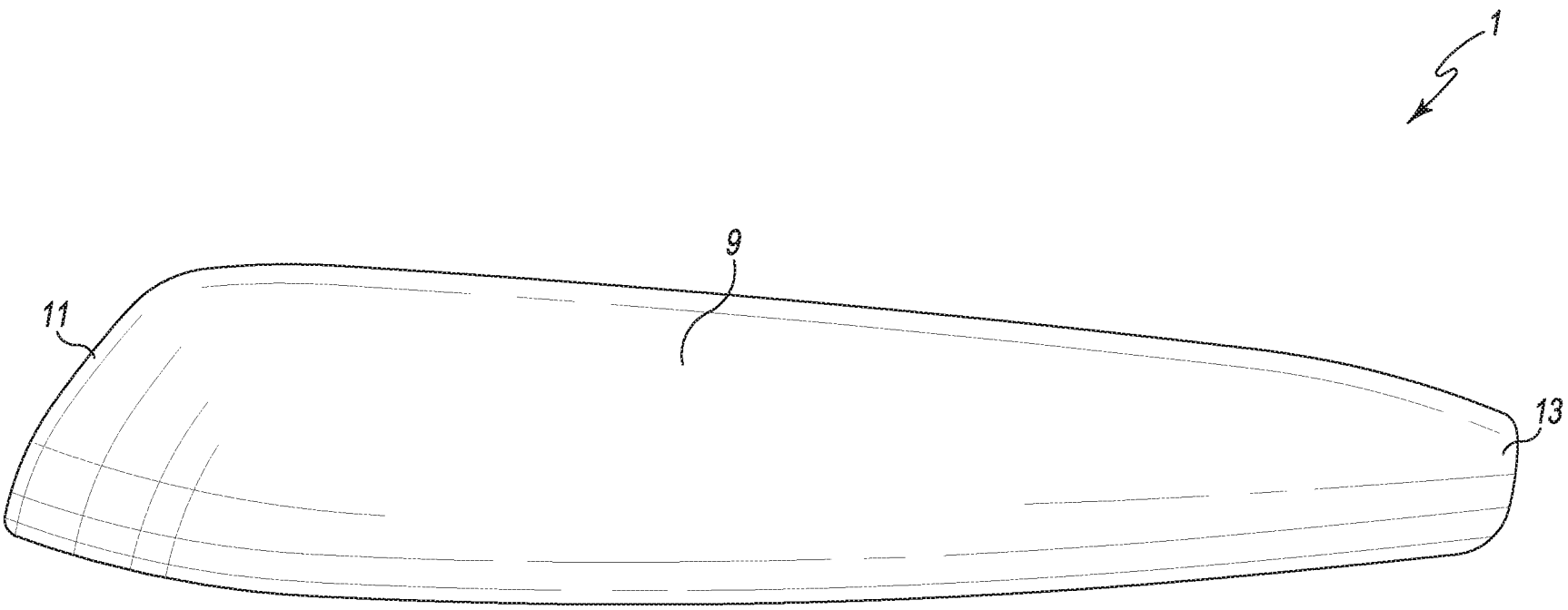
FIG. 9 shows a side, elevational view of the socket of the joint pad assembly of FIG. 1.

Referring now to FIGS. 3-9, various views of socket 1 are shown. Socket 1 has a banked design and has a shape that substantially matches the user's joint. As used herein, banked refers to a canted or tilted design as shown in FIG. 6 and discussed further herein. As mentioned earlier, socket 1 includes a front face 4, a rear face 6, and a frame 2 that includes a proximal edge surface 11, a distal edge surface 13, a lateral edge surface 9, and a medial edge surface 7. As shown in FIGS. 2-8, edge surfaces 7-13 cooperate to form an aperture 5. In one embodiment, aperture 5 receives a portion of facet 3. In another embodiment, aperture 5 is filled with a pad or a gel filled pad to provide additional padding and gripping to the contact surface (e.g., a slick floor surface such as finished hardwood or tile surface) to the user. In a further embodiment, aperture 5 remains as an open space. Furthermore, aperture 5 of socket 1 is in an offset position with respect to facet 3 as described further herein.

As shown, frame 2 is oriented such that lateral edge surface 9 is adjacent to a lateral edge of the joint of a user (i.e., a side of the user farther from a centerline of a user's body) while medial edge surface 7 is adjacent to a medial edge of the joint of the user (i.e., an edge closer to the centerline of a user's body). Referring now to at least FIG. 5, socket 1 is asymmetrical in shape. As shown in FIG. 6, socket 1 has a banked or canted design which includes a lateral edge surface 9 having a height $H_2$ that is larger than a height $H_1$ of medial edge surface 7. In one embodiment, the height ratio of $H_1$ to $H_2$ is 1:3.5. Also, lateral edge surface 9 can include a groove or contour 29 (FIG. 1) to receive a point of the user's joint. For example, groove 29 in lateral edge surface 9 receives the fibula of a user in an embodiment where joint pad assembly 100 is a knee pad assembly. Similarly, a groove or contour 31 (FIG. 1) may be included on medial edge surface 7 to provide added comfort to the user. For example, groove 31 in medial edge surface 7 receives the tibia in an embodiment where joint pad assembly 110 is a knee pad assembly.

In addition, both lateral edge surface 9 and medial edge surface 7 are curved. Lateral edge surface 9 further includes an axis A therethrough which intersects a plane B of the front face 4 of socket 1 to form an angle θ, which represents the degree to which socket 1 is canted. In one embodiment, socket 1 has an angle θ that is between 10 degrees and 20 degrees. As described further herein, the banked or canted design of socket 1 enables the joint pad assembly 100 to shift the impact of a force applied on joint pad assembly 100 to the lateral edge surface 9 of socket 1 while still providing support and stability to the user such that the user can comfortably maintain his/her position (e.g., a kneeling position).

In addition, frame 2 of socket 1 includes a proximal edge surface 11 that is contoured to hug a portion of the user's joint to maintain the orientation of socket 1 and prevent joint pad assembly 100 from sliding away from the joint. In one exemplary embodiment, proximal edge surface 11 hugs the patella of a user's knee. However, it is contemplated that in alternate embodiments, proximal edge surface 11 can hug portions of other joints in alternate applications (e.g., shoulder, elbow, etc.). Frame 2 also includes a distal edge surface 13 that is contoured to form an aperture 13A. Aperture 13A receives another portion of the joint to further couple socket 1 and joint pad assembly 100 to the joint. For example, in the knee pad application, distal edge surface 13 and aperture receive and hug the tibia of the user.

Frame 2 of socket 1 can be made of a hard, rigid plastic. This material provides frame 2 with flexibility such that joints of different sizes may be accommodated by frame 2 and joint pad assembly 100. It is within the scope of the present disclosure that joint pad assembly 100 may be made of alternate materials that provide the requisite flexibility to joint pad assembly 100, such as acrylic, PVC, or other types of plastic, for example.

As mentioned previously, facet 3 is configured to be seated within socket 1 and contact the user's joint. More particularly, front face 12 of facet 3 is received within rear face 6 of socket 1. In one embodiment, facet 3 includes a protrusion 8 that has a substantially similar shape to that of aperture 5, and protrusion 8 is received within aperture 5 to provide added comfort to the user.

Figure 12:
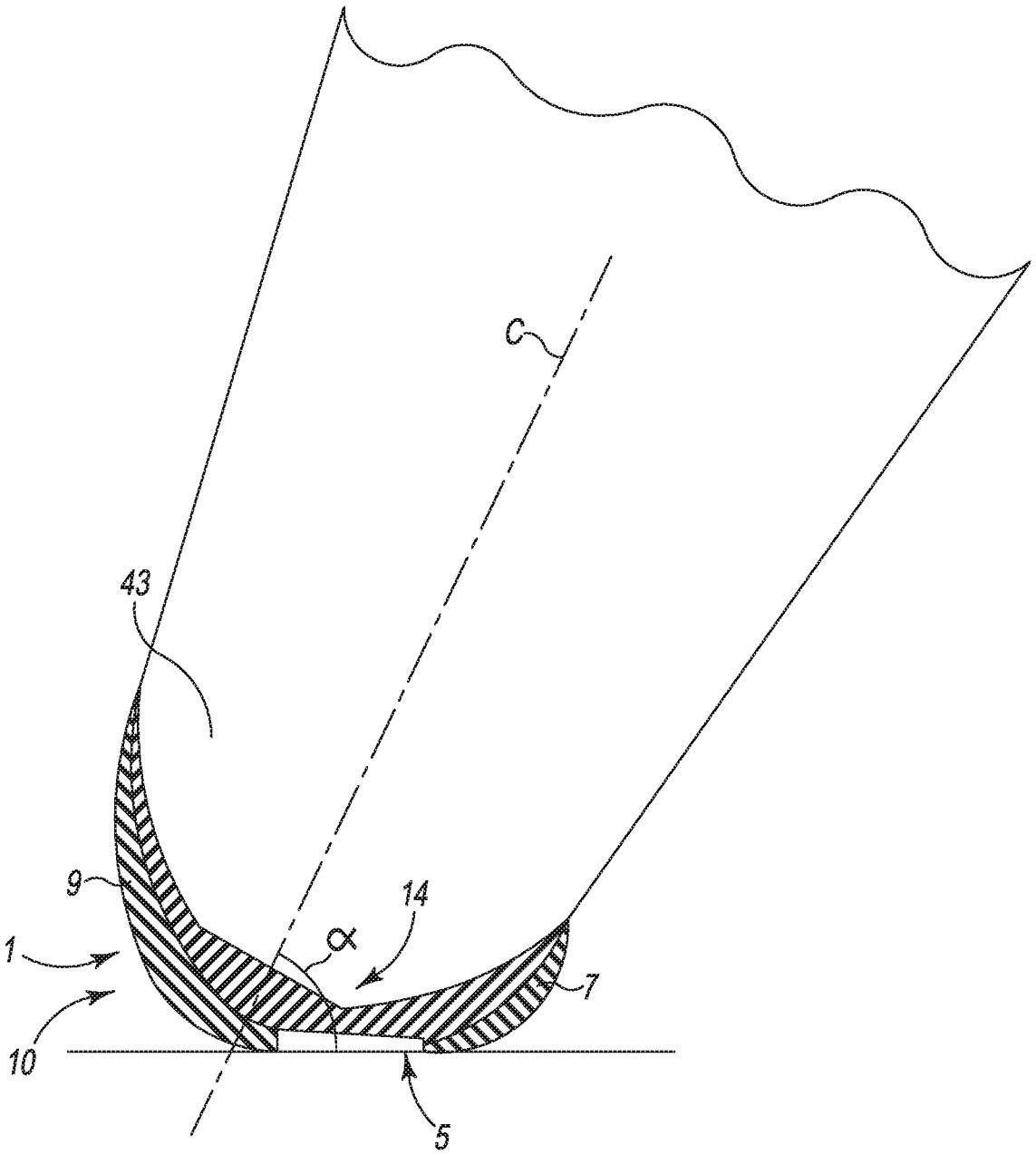
FIG. 12 shows a top, sectional view of the joint pad assembly of FIG. 11 as positioned on the user's knee without the securing sleeve.
Figure 13:
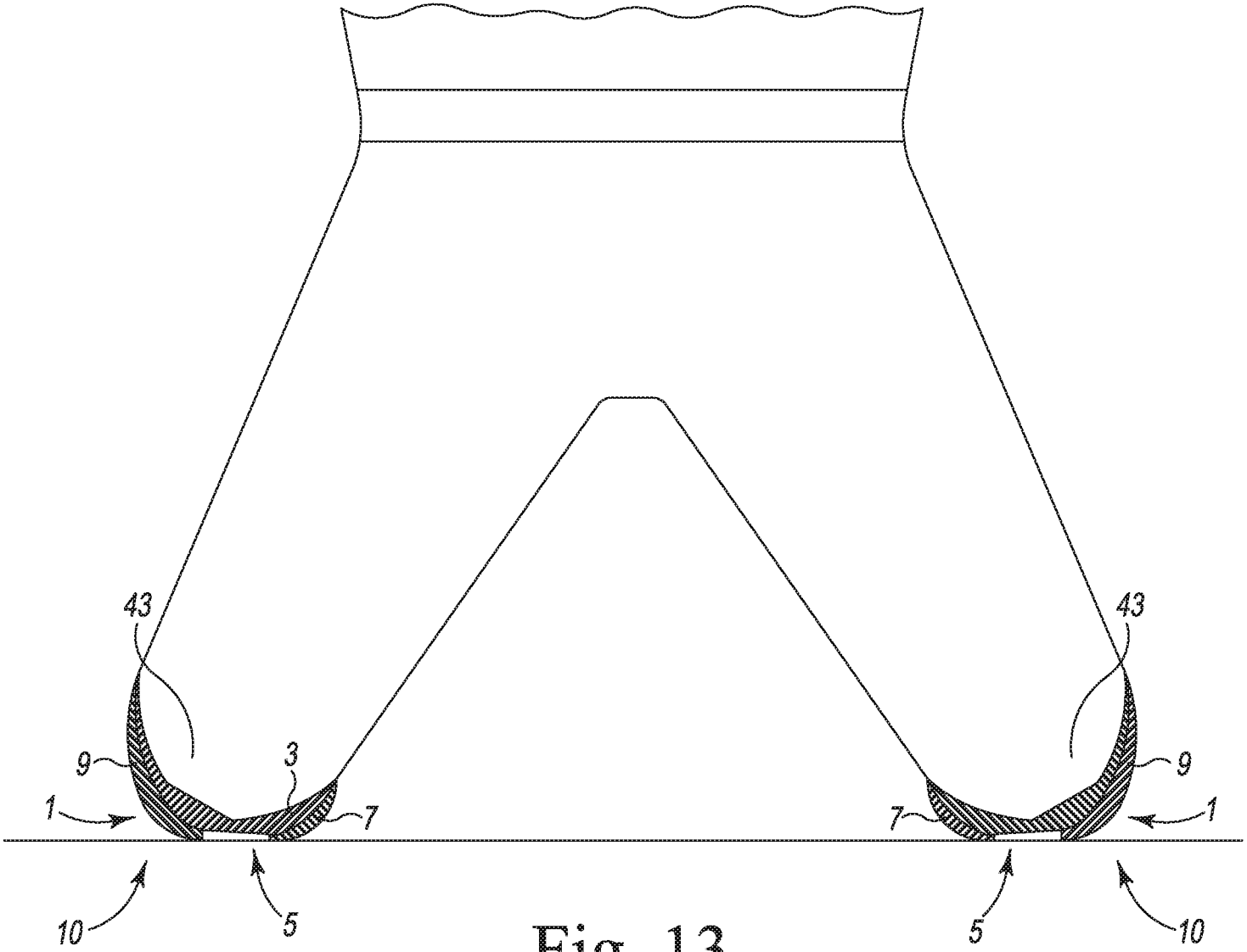
FIG. 13 shows a top, sectional view of the joint pad assembly of FIG. 11 as positioned on the user's knees without the securing sleeve.

Facet 3 can be made of a single or dual density foam padding or cushion. This material provides the user with cushioning to prevent discomfort when a user's joint (e.g., knee) is placed within socket assembly 10 as shown in FIGS. 12 and 13 discussed further herein. It is within the scope of the present disclosure that joint pad assembly 100 may be made of alternate suitable materials that provide the requisite comfort to the user silicone gel or polyurethane foam or the like, for example. In one embodiment, facet 3 has a shore hardness between 15 and 30. In a further embodiment, facet 3 has a shore hardness of approximately 25.

Referring now to FIG. 10, a securing strap 15 for use in joint pad assembly 100 is shown. Securing strap 15 functions to couple joint pad assembly 100 to the user's joint or body (e.g., the knee of a user). Securing strap 15 includes a sheet 15A that includes a front face 37 configured to couple to socket assembly 1 and a rear face 39 configured to receive a user's joint. Sheet 15A further includes a medial end 23 that includes an upper strap 19 and a lower strap 21. Upper strap 19 and a lower strap 21 are configured to couple securing strap 15 and joint pad assembly 100 (FIG. 11) to the user's joint. To do so, upper strap 19 and lower strap 21 wrap around the user's joint and couple to securing patches 25, 27, respectively, which are coupled to sheet 15A at a lateral end of securing strap 15. In one embodiment, upper strap 19 is approximately half the width of lower strap 21 (i.e., lower strap 21 is approximately two times the size of upper strap 19). The difference in size between straps 19 and 21 assist in ensuring stable placement of straps 19, 21 (i.e., offsetting various forces that could move joint pad assembly 100 when applied onto a user's joint) when installing joint pad assembly 100 onto the user. However, it is contemplated that in alternate embodiments, different proportions between the width of upper strap 19 and the width of lower strap 21 may be used. This along with the specialized design of the straps allow for a highly stable knee pad system that may be worn under the clothing.

In one embodiment, upper strap 19 and lower strap 21 are each made of approximately 1.5 mm thick neoprene with nylon or polyester fabric on a side of joint pad assembly 100 opposite of where the joint would be received and loop fabric on the inside side of joint pad assembly 100 that latches onto securing patches 25 and 27, which are made of hook fabric, and sewn to the medial side of the frame. In another embodiment, straps 19, 21 and patches 25, 27 are made from a soft neoprene material The thickness of the fabrics used for straps 19 and 21 can vary between 1 mm and 2 mm. Thicknesses in this range allow the straps to provide proper tension when straps 19 and 21 are coupled to patches 25 and 27 to keep joint pad assembly 100 in place when coupled to patches 25 and 27. Additionally, a thickness within the aforementioned range provides joint pad assembly 100 with enough flexibility to contort with the knee joint throughout its range of motion when the user's legs are in motion (e.g., flexion of the knee joint) without providing additional tension on the knee joint and the user's leg. In other words, the joint pad assembly 100 does not limit the range of motion in the knee joint of the user. In one embodiment, this type of strapping provides joint pad assembly 100 with 50% more flexibility than standard designs. Moreover, the flexibility in straps 19, 21 provides additional comfort to the user.

Furthermore, the soft velvet loop fabric on the interior side of joint pad assembly 100 provides a comfortable fit when the fabric contacts the user's body (e.g., calf if installed on the user's led) as opposed to other materials employed in other knee pads (e.g., with hard hook materials and the like) that have hard or sharp edges that can pinch or dig into the user's skin on the backside of the leg and/or on the inside of the knee joint.

Figure 11:
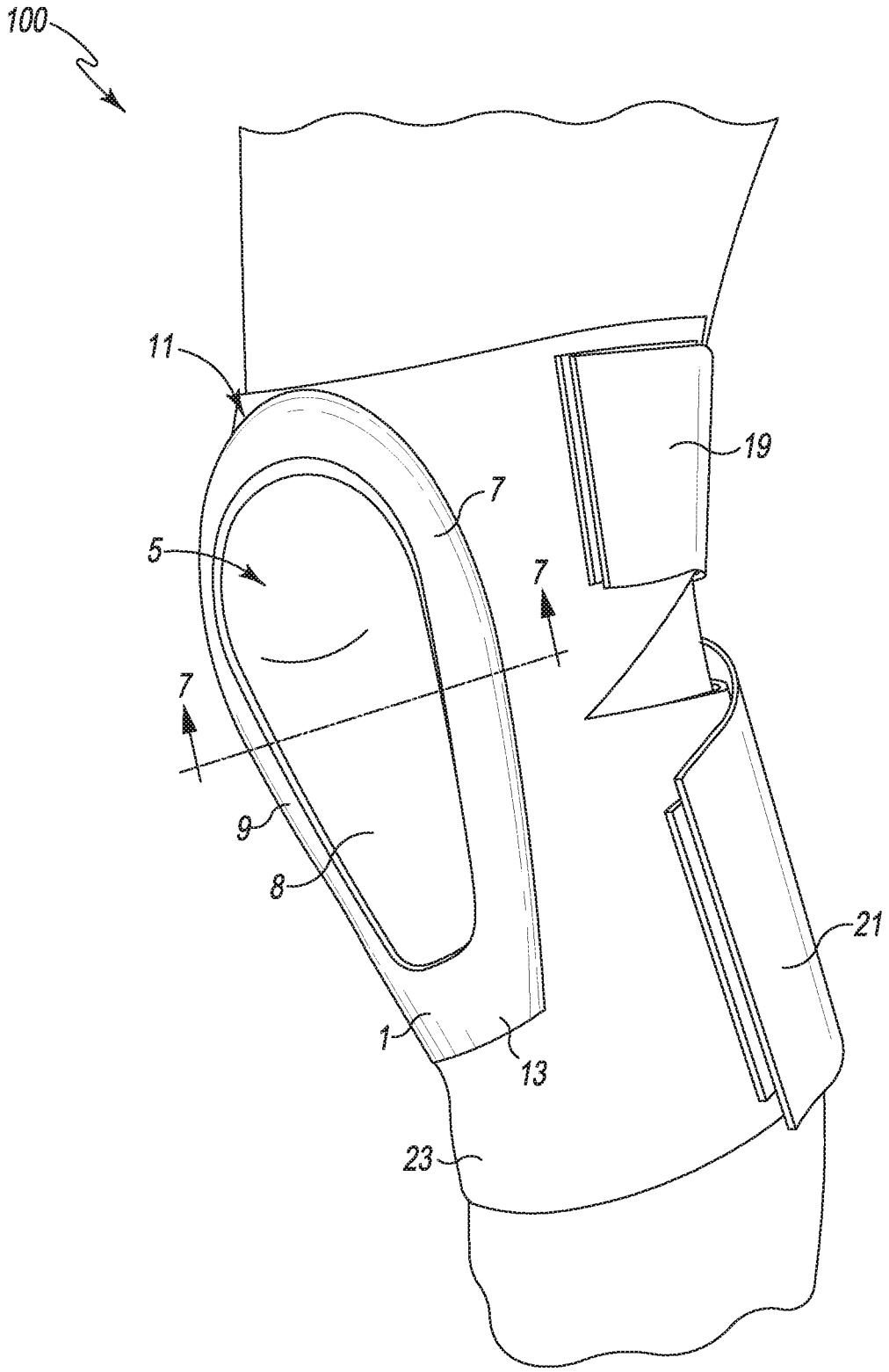
FIG. 11 shows a perspective view of the joint pad assembly of FIG. 1 as secured on a user's knee.

Securing strap 15 can further include a cushioning apparatus 17 on rear face 37 that has a shape that mirrors the shape of the user's joint. For example, as shown in FIG. 10, cushioning apparatus 17 is shaped to mirror the shape of a user's patella. However, it is within the scope of the present disclosure that cushioning apparatus 17 may be sized and shaped to mirror the shape of an alternate joint of the user (e.g., shoulder, elbow, etc.). Cushioning apparatus 17 is configured to provide additional padding, comfort, and force absorption to the user when in use with joint pad assembly 100 as shown in FIG. 11 and described further herein. Cushioning apparatus 7 may be made of silicone gel, polyurethane foam or other suitable material. In another embodiment, cushioning apparatus 7 may be made from polyethylene or other foam compositions.

Referring now to FIG. 11, a fully assembled joint pad assembly 100 is shown. FIG. 11 shows joint pad assembly 100 as a knee pad. However, it is contemplated that in alternate embodiments, joint pad assembly 100 can be used for other joints (e.g., elbow, shoulder, etc.). As shown, joint pad assembly 100 is worn directly on the surface of a user's leg, in direct contact with the skin. This direct contact assists to hold joint pad assembly 100 in place throughout various ranges of motion in combination with the contoured design and the size ratio of the straps.

To assemble joint pad assembly 100 onto a user's knee, joint pad assembly 100 is wrapped around the user's knee via securing strap 15 such that cushioning apparatus 17 aligns with and hugs the user's patella tibia. In doing so, the user's patella will also be received in rear face 14 of facet 3 and rear face 6 of socket 1. Once this alignment is made, straps 19, 21 are wrapped around the user's knee to create a snug fit between joint pad assembly 100 and the user's knee as shown in FIG. 11. Straps 19, 21 couple to patches 25, 27 to retain the snug fit and any excess material of straps 19, 21 can be removed by scissors (not shown).

FIGS. 12 and 13 show the assembled joint pad assembly 100 in application when a user is kneeling without securing strap 15. As shown, a user's knee 39 is received in rear face 14 of facet 3, and knee 39 and facet 3 share a common axis of symmetry C. Socket 1 is coupled to facet 3 and includes aperture 5 as further shown in FIGS. 12 and 13. Front face 4 of socket 1 squarely contacts the ground 41. Since front face 4 is offset with respect to facet 3 (due to the banked or canted configuration of socket 1), axis C of knee 39 is at an angle $\alpha$ with ground 41. This orientation creates a vertical force that stabilizes the knee rather than allowing a horizontal force to push the knee laterally. In one embodiment, angle $\alpha$ is between 10 degrees and 15 degrees. The resulting angled configuration of socket 1 provides impact protection to the knee joint by dispersing a portion of the force of impact around the frame 2 of socket 1 before cushioning apparatus 17 absorbs the rest of the force. In one embodiment, frame 2 absorbs a majority of the impact force and cushioning apparatus 17 absorbs the remainder of the force. The combination of load/force dispersion via socket 1 and cushioning apparatus 17 (FIG. 10) to disperse the load force allows for socket 1 to be thicker and have heavier edge surfaces to displace more load to the outer edge surfaces 7, 9 of socket 1 such that the impact of the load force on the knee joint of the user is less as portions of the knee joint are not in contact with the ground. Stated another way, facet 3 and securing strap 15 (FIG. 10) are square with the user's knee (patella) 43, while socket 1 holds the side of knee 43 steady by converting and distributing the applied lateral forces to vertical forces up lateral and medial edge surfaces 7, 9 of socket 1. This arrangement allows for substantially stability and comfort while kneeling, and the design of joint pad assembly 100 takes advantage of the user's natural kneeling position to increase stability and comfort.

Socket 1 further holds the shape and structure of cushioning apparatus 7 when the user gets on their knees and in effect, prolongs the life of cushioning apparatus 17 by preventing cushioning apparatus 17 from flattening out upon use. Furthermore, in addition to socket 1 displacing a force/load, socket 1 also maintains the contour of the knee joint to securely hug the knee that prevents any side movement or downward movement along the user's leg when in use. Moreover, when the user lands on his/her knees, the knee joint is forced into socket 1 and joint pad assembly 100 without the user having to make adjustments. Further, lateral edge surface 9 of socket 1 is high walled and made from a rigid plastic that prevents twisting of socket 1 because it is secured to the side of the knee joint and runs vertically from the surface of the ground when one is on their knees. Lateral edge surface 9 also eliminates side or top side rollout due to the high walled nature of lateral edge surface 9. The open area of socket encompassing the facet 1 on the exterior part of the assembly is slightly elevated from the ground surface to provide an additional cushion for the patella and tibia to fall into for added comfort. As mentioned previously, the space may also be filled with a soft gel material that would provide additional grip to a slick floor surface such as finished hardwood or tile surface.

Moreover, when a person on their knees tends to naturally spread their knees apart to maintain balance and support while kneeling. The angle of the thighs relative to ground 41 can be between approximately 78 degrees to 82 degrees, which applies outward forces on knee 39 and the MCL of knee 39. To offset this lateral load or force, lateral edge surface 9 of socket 1 has a greater thickness than medial edge surface 7. The additional thickness functions similarly to a wheel chock in that the additional lateral force applied onto joint pad assembly 100 results in a greater force transfer in the vertical plane to the ground pushing joint pad assembly 100 firmly against the ground. This aspect offers substantial stability to the user while kneeling.

Advantageously, a benefit of the configuration of this design is that it is maximally efficient at distributing the load on the knee joint. Additionally, joint pad assembly 100 allows cushioning apparatus 17 to be smaller or thinner in size, but in combination with the contoured design, provide the same benefits as a bulkier, heavier joint pad assembly 100. Moreover, the smaller and slimmer design of joint pad assembly 100 allows the user to wear joint pad assembly 100 under his/her clothing.

For the purposes of describing and defining the present invention it is noted that the use of relative terms such as "substantially", "generally", "approximately" and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act or instruction used in this description should be construed as important, necessary, critical or essential to the invention unless explicitly described as such. Although only a few of the exemplary embodiments have been described in detail herein and those skilled in the art will readily appreciate that many modifications are possible in these exemplary embodiments without materially departing from the novel teachings and advantages of this invention. Accordingly, all such modifications are intended to be included within the scope of this invention.

The phrase "in one embodiment" is used repeatedly. The phrase generally does not refer to the same embodiment; however, it may. The terms "comprising," "having" and "including" are synonymous, unless the context dictates otherwise. The following illustrations of various embodiments use particular terms by way of example to describe the various embodiments, but this should be construed to encompass and provide for terms such as "method" and "routine" and the like. Various aspects of the illustrative embodiments will be described using terms commonly employed by those skilled in the art to convey the substance of their work to others skilled in the art. However, it will be apparent to those skilled in the art that the embodiments described herein may be practiced with only some of the described aspects. For purposes of explanation, specific numbers, materials and configurations are set forth in order to provide a thorough understanding of the illustrative embodiments. However, it will be apparent to one skilled in the art that the embodiments described herein may be practiced without the specific details. In other instances, well-known features are omitted or simplified in order not to obscure the illustrative embodiments.

The characteristics and utilities of the present invention described in this summary and the detailed description below are not all inclusive. Many additional features and advantages will be apparent to one of ordinary skill in the art given the following description. There has thus been outlined, rather broadly, the more important features of the invention in order that the detailed description thereof that follows may be better understood, and in order that the present contribution to the art may be better appreciated.

In this respect, by explaining at least one embodiment of the invention in detail, it is to be understood that the invention is not limited in its application to the details of construction and to the arrangements of the components set forth in the description. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the description be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, nor is it intended to be limiting as to the scope of the invention in any way. The characteristics and utilities of the present invention described in this summary and the detailed description below are not all inclusive. Many additional features and advantages will be apparent to one of ordinary skill in the art given the detailed description.

While the invention has been described by reference to various specific embodiments it should be understood that numerous changes may be made within the spirit and scope of the inventive concepts described, accordingly, it is intended that the invention not be limited to the described embodiments but will have full scope defined by the language of the following claims.

What is claimed is:

1. A joint pad assembly comprising:

a socket assembly including:

a socket including a frame that includes a front face, a rear concave face configured to receive a joint of a user, a lateral edge surface and a medial edge surface; and a facet coupled to the socket, the facet including a rear surface configured to receive the joint of the user and a front surface configured to abut the rear concave face of the socket;

wherein the lateral edge surface has a lateral edge surface height that is larger than a medial edge surface height of the medial edge surface;

wherein the frame surrounds an aperture positioned between the lateral edge surface and the medial edge surface along the front face of the frame, the aperture configured to receive the user's joint and the front surface of the facet abutting the rear concave face of the socket at least around a perimeter of the aperture; and wherein an axis of symmetry extends through the socket, and the aperture is offset from the axis of symmetry toward the medial edge surface.

2. The joint pad assembly of claim 1, wherein a plane formed by the front face and a plane formed by the lateral edge surface intersect to form an angle between 10 degrees and 20 degrees such that the socket assembly is canted.

3. The joint pad assembly of claim 1, further including a securing sleeve comprising a distal end and an upper strap and a lower strap coupled to the distal end, wherein the lower strap is at least twice as large as the upper strap.

4. The joint pad assembly of claim 1, wherein:

the lateral edge surface includes a contour configured to receive a fibula of the user's joint; and the medial edge surface includes a contour configured to receive a tibia of the user's joint.

5. A joint pad assembly comprising:

a socket assembly including:

a socket including a frame that includes a front face, a rear concave face defining a vertex and configured to receive a joint of a user, a lateral edge surface and a medial edge surface; and a facet coupled to the socket, the facet configured to receive the joint of the user, wherein a plane formed by the front face and a plane formed by the lateral edge surface intersect to form an angle such that the socket assembly is canted;

wherein the frame surrounds an aperture entirely positioned between the vertex and the medial edge surface along the front face of the frame;

wherein the aperture is configured to be offset from an axis of bisection of the facet toward the medial edge surface; and wherein the axis of bisection of the facet is at an angle of between 10 degrees and 15 degrees from the front face.

6. The joint pad assembly of claim 5, further including a securing sleeve comprising a distal end and an upper strap and a lower strap coupled to the distal end, wherein the lower strap is at least twice as large as the upper strap.

7. The joint pad assembly of claim 6, wherein the facet is received with the rear face of the socket.

8. The joint pad assembly of claim 5, wherein:

the lateral edge surface includes a contour configured to receive a fibula of the user's joint; and the medial edge surface includes a contour configured to receive a tibia of the user's joint.

9. A joint pad assembly comprising:

a socket assembly including:

a socket including a frame that includes a front face, a rear concave face defining a vertex and configured to receive a joint of a user, a lateral edge surface and a medial edge surface;

wherein the frame surrounds an aperture entirely positioned between the vertex and the medial edge surface along the front face of the frame; and a facet coupled to the socket and received within the rear face of the frame of the socket, wherein the facet is configured to squarely receive the joint of the user;

wherein the aperture is configured to be offset from an axis of bisection of the facet toward the medial edge surface;

wherein the lateral edge surface includes a contour configured to receive a fibula of the user's joint; and wherein the medial edge surface includes a contour configured to receive a tibia of the user's joint.

10. The joint pad assembly of claim 9, wherein the lateral edge surface has a lateral edge surface height that is larger than a medial edge surface height of the medial edge surface.

11. The joint pad assembly of claim 10, wherein a plane formed by the front face and a plane formed by the lateral edge surface intersect to form an angle between 10 degrees and 20 degrees such that the socket assembly is canted.

12. The joint pad assembly of claim 9, further including a securing sleeve comprising a distal end and an upper strap and a lower strap coupled to the distal end, wherein the lower strap is at least twice as large as the upper strap.

13. The joint pad assembly of claim 12, wherein the securing sleeve further includes a cushion coupled to the distal end of the securing sleeve.

14. A joint pad assembly comprising:

a socket assembly including:

a socket including a frame that includes a front face, a rear concave face defining a vertex and configured to receive a joint of a user, a lateral edge surface and a medial edge surface;

wherein the frame defines an aperture entirely positioned between the vertex and the medial edge surface along the front face of the frame;

wherein the lateral edge surface has a lateral edge surface height that is larger than a medial edge surface height of the medial edge surface; and a securing sleeve comprising an upper strap, a lower strap, and a cushioning apparatus attached to the securing sleeve and configured to mirror a shape of the joint of the user, and the socket is configured to hold the shape of the cushioning apparatus when force is applied to the front face of the socket so that the cushioning apparatus has a consistent shape, the upper strap and the lower strap each configured to removably couple with an upper securing patch attached to a lateral edge of the securing sleeve and a lower securing patch attached to a lateral edge of the securing sleeve.

15. The joint pad assembly of claim 14, wherein the aperture is configured to be offset from an axis of bisection of the facet toward the medial edge surface.

16. The joint pad assembly of claim 15, wherein the axis of bisection of the facet is at an angle of between 10 degrees and 15 degrees from the front face.

17. The joint pad assembly of claim 14, wherein a plane formed by the front face and a plane formed by the lateral edge surface intersect to form an angle between 10 degrees and 20 degrees such that the socket assembly is canted.

18. The joint pad assembly of claim 14, wherein the lower strap is at least twice as large as the upper strap.

19. The joint pad assembly of claim 14, the cushioning apparatus is positioned on the securing sleeve so that the cushioning apparatus is configured to receive a patella of the user.

* * * * *